US010147341B2

(12) United States Patent
Berbert et al.

(10) Patent No.: US 10,147,341 B2
(45) Date of Patent: Dec. 4, 2018

(54) TAMPER EVIDENT LABEL WITH FULLY ENCLOSED PEEL TAB

(71) Applicant: BEMIS COMPANY, INC., Neenah, WI (US)

(72) Inventors: Otacilio T. Berbert, Oshkosh, WI (US); Reinaldo Caleman, Neenah, WI (US)

(73) Assignee: Bemis Company, Inc., Neenah, WI (US)

( * ) Notice: Subject to any disclaimer, the term of this patent is extended or adjusted under 35 U.S.C. 154(b) by 0 days.

(21) Appl. No.: 15/515,183

(22) PCT Filed: Sep. 30, 2015

(86) PCT No.: PCT/US2015/053221
§ 371 (c)(1),
(2) Date: Mar. 29, 2017

(87) PCT Pub. No.: WO2016/060846
PCT Pub. Date: Apr. 21, 2016

(65) Prior Publication Data

US 2017/0236453 A1 Aug. 17, 2017

Related U.S. Application Data

(60) Provisional application No. 62/064,821, filed on Oct. 16, 2014.

(51) Int. Cl.
*G09F 3/00* (2006.01)
*G09F 3/10* (2006.01)
*G09F 3/02* (2006.01)

(52) U.S. Cl.
CPC ..... *G09F 3/0292* (2013.01); *G09F 3/10* (2013.01); *G09F 2003/0257* (2013.01); *G09F 2003/0272* (2013.01)

(58) Field of Classification Search
CPC .. G09F 3/0292; G09F 3/10; G09F 2003/0257; G09F 2003/0272
See application file for complete search history.

(56) References Cited

U.S. PATENT DOCUMENTS 4,679,693 A 7/1987 Forman
4,840,270 A 3/1989 Caputo et al.
(Continued)

FOREIGN PATENT DOCUMENTS

CN 1636838 A 7/2005
EP 1205398 A1 5/2002
(Continued)

OTHER PUBLICATIONS

Food Processing, "Peel and Re-Close Packaging System Available for Thermoform Packaging Applications", retrieved online Oct. 8, 2014 at http://www.foodprocessing.com/vendors/products/2009/243.

*Primary Examiner* — Patricia L. Nordmeyer
(74) *Attorney, Agent, or Firm* — Christine E. Parsons

(57) ABSTRACT

A tamper evident label with a fully enclosed peel tab is described. This label comprises a first edge, a second edge, a third edge, a fourth edge and a label interior. The label also comprises a tear strip comprising a first tab, a first portion having a first border and an opposing second border, a second portion having a third border and an opposing fourth border, and a scored edge. The second border of the first portion is adjacent the first edge of the label, the fourth border is adjacent the third edge of the label, and the scored edge is adjacent the first border and the third border of the first portion of the tear strip. The label further comprises a second tab comprising a first side and a second side. The first side is adjacent the first border, and the second side is adjacent the third border. Various embodiments of the label are also described.

17 Claims, 5 Drawing Sheets

(56) References Cited

U.S. PATENT DOCUMENTS

| | | | | |
|---|---|---|---|---|
| 5,100,180 | A * | 3/1992 | Tucker | A63F 3/0665 206/831 |
| 5,325,968 | A | 7/1994 | Sowden | |
| 5,405,692 | A | 4/1995 | Weng et al. | |
| 5,456,928 | A | 10/1995 | Hustad et al. | |
| 5,725,311 | A | 3/1998 | Ponsi et al. | |
| 5,758,774 | A | 6/1998 | Leblong | |
| 5,873,483 | A | 2/1999 | Gortz et al. | |
| 6,026,953 | A | 2/2000 | Nakamura et al. | |
| 6,329,034 | B1 | 12/2001 | Pendry et al. | |
| 6,589,622 | B1 | 7/2003 | Scott | |
| 6,874,623 | B2 | 4/2005 | Bray | |
| 6,918,532 | B2 | 7/2005 | Sierra-Gomez et al. | |
| 7,344,744 | B2 | 3/2008 | Sierra-Gomez et al. | |
| 7,497,331 | B2 | 3/2009 | Pham | |
| 7,681,732 | B2 | 3/2010 | Moehlenbrock et al. | |
| 7,717,620 | B2 | 5/2010 | Hebert et al. | |
| 7,823,726 | B1 * | 11/2010 | Miceli | G09F 3/10 206/459.5 |
| 7,963,413 | B2 | 6/2011 | Sierra-Gomez et al. | |
| 8,028,851 | B2 | 10/2011 | Vovan et al. | |
| 8,256,636 | B2 | 9/2012 | Huffer | |
| 8,414,031 | B2 * | 4/2013 | Hirose | G09F 3/10 283/81 |
| 8,541,081 | B1 | 9/2013 | Ranganathan et al. | |
| 8,545,099 | B2 | 10/2013 | Davis et al. | |
| 8,672,166 | B2 | 3/2014 | Nazareth et al. | |
| 8,684,217 | B2 | 4/2014 | Bruehl et al. | |
| 2007/0104915 | A1 * | 5/2007 | Blancato | G09F 3/0292 428/42.3 |
| 2007/0289893 | A1 | 12/2007 | Williams | |
| 2010/0044264 | A1 | 2/2010 | Raming | |
| 2013/0320019 | A1 | 12/2013 | Tinoco et al. | |
| 2013/0337212 | A1 | 12/2013 | Jensen | |
| 2016/0240111 | A1 * | 8/2016 | Beber Futernick | G09F 3/10 |
| 2017/0073136 | A1 | 3/2017 | Konicke | |

FOREIGN PATENT DOCUMENTS

| | | | |
|---|---|---|---|
| WO | 1998003349 | A1 | 1/1998 |
| WO | 2012128981 | A1 | 9/2012 |
| WO | 2014142886 | A1 | 9/2014 |
| WO | 2015002651 | A1 | 1/2015 |

* cited by examiner

TAMPER EVIDENT LABEL WITH FULLY ENCLOSED PEEL TAB

BACKGROUND OF THE INVENTION

Labels for accessing and/or repeatedly accessing the contents of a package are known. For example, U.S. Pat. No. 4,679,693 (Forman) discloses a resealable container with a tearable face opened and resealed by a label. The label includes multiple layers and, for tamper evidence, requires that an end-user remove a layer covering or overlaying a pull tab in order to access the pull tab. U.S. Pat. No. 7,681,732 (Moehlenbrock et al.) discloses a laminated lidstock including a substrate film, a support web, a pressure sensitive adhesive disposed between the substrate and support webs, a first die cut in the substrate film, a second die cut in the support web, a pull tab and a tamper evidence device. The pull tab and tamper evidence device are each coextensive with the width of the lidstock and, as such are coextensive with each other. Such labels may be positioned over or sealed to or otherwise applied to a bag (as, for example, in U.S. Pat. No. 4,679,693), a tray (as, for example, in U.S. Pat. No. 7,681,732) or other flexible, semi-rigid or rigid packaging (as each is known to a person of ordinary skill in the packaging arts).

BRIEF SUMMARY OF THE INVENTION

As noted in, for example, U.S. Pat. No. 7,681,732, such labels may include tamper evident features to indicate whether the label has been removed and/or the package contents have been initially accessed. However, many known tamper evident features or systems include an accessible tab by which the package may still be opened without any evidence of tampering. Other known tamper evident systems include multiple tamper evident features, and such multiplicities contribute to manufacturing inefficiencies and end-user complexities. For health and safety and for ease-of-use, today's consumer increasingly desires improved tamper evident features and systems.

This desire is met by the label described in the present application. This label comprises a first edge, a second edge, a third edge, a fourth edge and a label interior. The second edge of the label opposes the first edge, the third edge connects the first edge and the second edge, and the fourth edge connects the first edge and the second edge.

This label also comprises a tear strip comprising a first tab, a first portion having a first border and an opposing second border, a second portion having a third border and an opposing fourth border, and a scored edge. The second border of the first portion of the tear strip is adjacent the first edge of the label, the fourth border is adjacent the third edge of the label, and the scored edge is adjacent the first border and the third border. As such, the tear strip is defined by the scored edge and at least a segment of each of the first edge of the label and the third edge of the label.

This label further comprises a second tab comprising a first side and a second side. The first side of the second tab is adjacent the first border of the first portion of the tear strip and the second side is adjacent the third border of the second portion of the tear strip. As such, the second tab is defined by the first border, the third border and the label interior.

In some embodiments, the first tab may facilitate removal of the tear strip from the label. In some embodiments, the second tab may facilitate removal of the label from a package or otherwise.

In same embodiments, the tear strip may be further defined by at least a segment of the fourth edge of the label. In these embodiments, the tear strip may extend the width of the first edge of the label from the third edge of the label to the fourth edge of the label. In some of these embodiments, the label may include a rounded corner at the connection or intersection of the first edge of the label and the fourth edge of the label.

In some embodiments, the tear strip (extends partially the width of the first edge of the label and partially the width of the third edge of the label.

In some embodiments, the second tab may have a shape of a right triangle, a circle, half-circle, oval, half-oval, square, rectangle, pentagon or hexagon.

in some embodiments, the tear strip and the second tab may be in the same plane, such that the tear strip does not cover or otherwise overlay the second tab.

In some embodiments, the label may be a multilayer label. The multilayer label may comprise a removable adhesive layer and/or an exterior layer. The removable adhesive layer may comprise material to facilitate grasping of the first tab, the second tab, or both the first tab and the second tab. The exterior layer may be scored and/or may comprise a sealant layer.

In some embodiments, a package may comprise the label as described in the present application. In some of these embodiments, the package may be a tray.

DETAILED DESCRIPTION OF THE INVENTION

This application describes a label with a fully-enclosed peel tab. A substantially L-shaped tear strip is adjacent a first side and an adjoining second side (e.g., the bottom side and the adjoining side) of the outermost edges of the peel tab. The label interior is adjacent the innermost sides (or sides) of the peel tab. The substantially L-shaped tear strip functions as a tamper-evident system in that an end-user cannot access the outermost edges of the peel tab (i.e., those edges an end-user grasps to fully or partial remove the label and/or to open the package) until the tear strip is removed. The end-user is able to determine whether the package contents have been accessed or the label has otherwise been tampered if the substantially L-shaped tear strip is removed (or otherwise not present) or partially torn.

Figure 1:
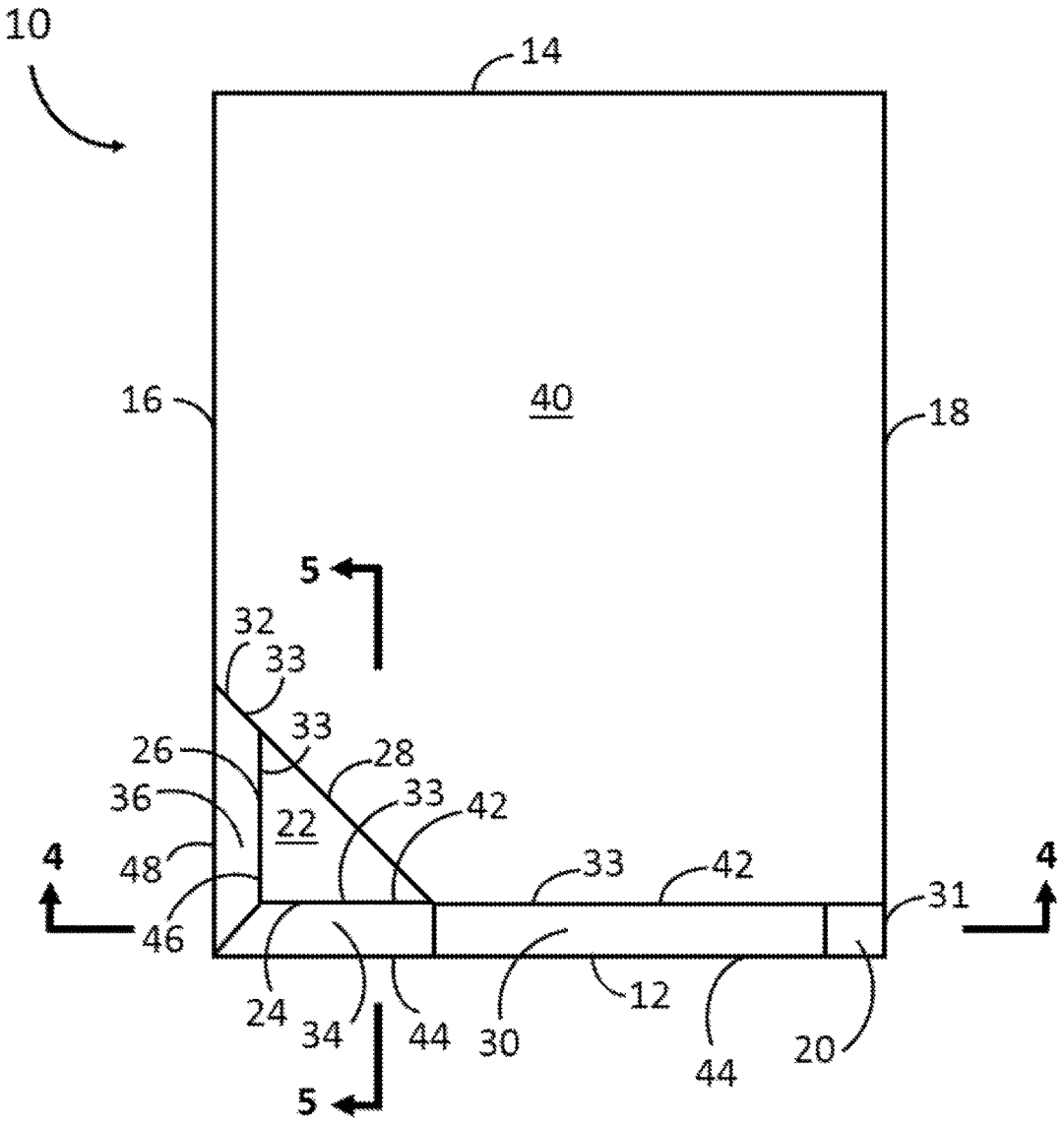
FIG. 1 is a schematic top view of a first embodiment of a label according to the present application.

Referring now to the drawings, with some but not all embodiments shown, with elements depicted as illustrative and not necessarily to scale, and with the same (or similar) reference numbers denoting the same (or similar) features throughout the drawings, FIG. 1 is a schematic top view of a first embodiment of a label according to the present application. Label 10 includes first edge 12 and opposing second edge 14 connected by third edge 16 and fourth edge 18. Label 10 also includes first tab 20 and second tab 22.

Second tab 22 includes first side 24, adjoining second side 26 and adjoining third side 28. Label 10 further includes tear strip 30 (having first end 31 and second end 32). First tab 20 is near first end 31 of tear strip 30. As used in this application, "near" means being reasonably close to or in the vicinity of.

Tear strip 30 in the embodiment of FIG. 1 extends substantially the width of first edge 12 is from third edge 16 to fourth edge 18 and partially the width of third edge 16. As used in this application, the term "width" in connection with a dimension between opposed side edges of the label should be construed broadly and not narrowly as contrasted with "length". Thus, for example, for a rectangle having sides or edges of length "a" and "b", where a>b, "a" may be said to be a width of the rectangle, but "b" may also be said to be a width of the rectangle.

Tear strip 30 has first portion 34 and second portion 36. Tear strip 30 also includes first border 42, second border 44, third border 46, and fourth border 48. First portion 34 (having first border 42 and opposing second border 44) of tear-strip 30 is adjacent first side 24 of second tab 22; second portion 36 (having third border 46 and opposing fourth border 48) of tear-strip 30 is adjacent second, side 26 of second tab 22; and label interior 40 is adjacent and surrounds third side 28 of second tab 22. More specifically, first border 42 of first portion 34 is adjacent first side 24 of second tab 22, second border 44 of first portion 34 is adjacent first edge 12 of label 10, third border 46 of second portion 36 is adjacent second side 26 of second tab 22, and fourth border 48 of second portion 36 is adjacent third edge 16 of label 10. As used in this application, "adjacent" means touching, having a common boundary or having direct contact.

Tear strip 30 also includes scored edge 33. Scored edge 33 is substantially positioned in label interior 40 and is also adjacent first border 42 and third border 46. Label interior 40 is any area of label 10 not adjacent first edge 12, opposing second edge 14, third edge 16 or fourth edge 18. Scored edge 33 may be a continuous or non-continuous series of holes, vents, slits, slots, perforations, notches, punctures, orifices, openings, inlets, channels, etc., in a surface of or through an exterior layer of label 10. The holes, vents, slits, slots, perforations, notches, punctures, orifices, openings, inlets, channels, etc., of scored edge 33 may have varying depth. The depth may extend throughout the entire thickness of the label, or the depth may extend only through a portion of the thickness of the label. The holes, vents, slits, slots, perforations, notches, punctures,orifices, openings, inlets, channels, etc.,of scored edge 33 may be formed by mechanical means (e.g., a cutting blade), by chemical means (e.g., solvents), by thermal means (e.g., optical ablation) or by other means known in the art.

In the embodiment shown in FIG. 1, tear strip 30 is defined by scored edge 33 and at least a segment of each of first edge 12, third edge 16 and fourth edge 18. As used in this application. "defined by" means bounded, delineated, outlined, circumscribed or otherwise demarcated.

Figure 2:
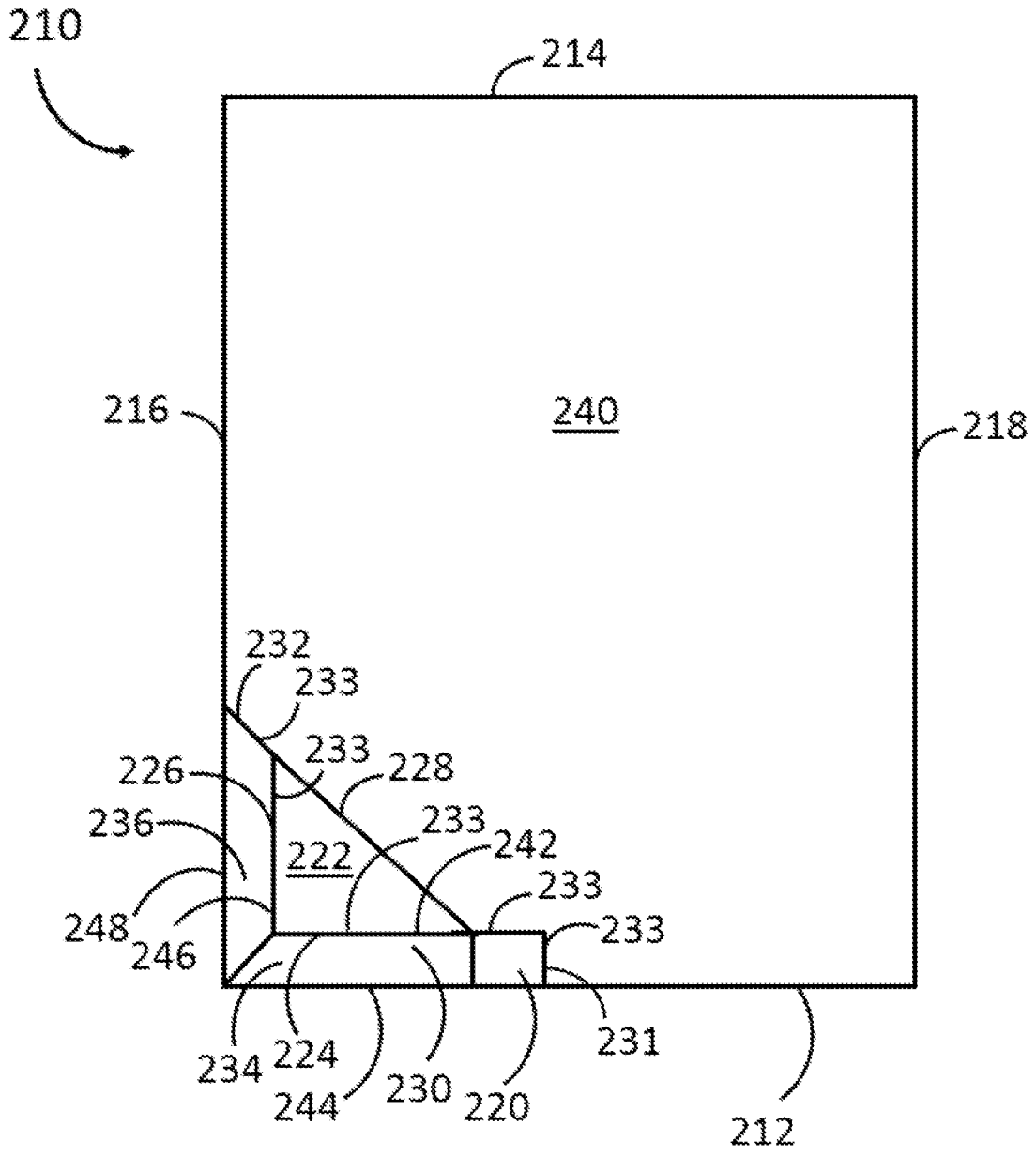
FIG. 2 is a schematic top view of second embodiment of a label according to the present application.

In the embodiment shown in FIG. 2, second tab 22 is defined by first border 42 of first portion 34 of tear strip 30, third border 46 of second portion 36 of tear strip 30 and label interior 40. As such, second tab 22 is not defined by first edge 12 of label 10 or third edge 16 of label 10.

In FIG. 1, second end 32 of tear strip 30 is depicted as angled; however, in other embodiments, second end 32 may be straight or any other shape extending from, for example, the juncture, connection or intersection of second side 26 and third side 28 of second tab 22 to a point on third edge 16.

FIG. 1 depicts second tab 22 having a shape of a right triangle; however, in other embodiments, second tab 22 may have other shapes, such as circle, half-circle, oval, half-oval, square, rectangle, pentagon, hexagon or otherwise, provided (i) first portion 34 of tear strip 30 is positioned between and adjacent first side 24 (i.e., the "side" or curved portion of second tab 22 near first edge 12) such that first side 24 is not adjacent first edge 12, (ii) second portion 36 of tear strip 30 is positioned between and adjacent second side 26 (i.e., the "side" or curved portion of second tab 22 near third edge 16) such that second side 26 is not adjacent third edge 16, and (iii) label interior 40 is positioned adjacent and surrounds remaining 'side' or curved portions of second tab 22 such that the remaining "sides" or curved portions are not adjacent first edge 12, second edge 14, third edge 16 or fourth edge 18. As such, second tab 22 may function as a fully-enclosed peel tab, not accessible from edges of label 10.

In view of the possible curvature-shape of second tab 22, first portion 34 of tear strip 30 need not be at a right angle to second portion 36 of tear strip 30. The intersection of first portion 34 and second portion 36 of tear-strip 30 and, correspondingly, the intersection of first side 24 and second side 26 of second tab 22 may include some curvature.

With or without some curvature as described above, as tear strip 30 is positioned near not only one edge but two edges of label 10, label 10 has some component that is substantially L-shaped. As described above, the L-shaped tear strip is adjacent a first side and an adjoining second side (e.g., first side 24 and second side 26) of the outermost edges of the peel tab (e.g., second tab 22). As such, in some embodiments, the L-shaped tear strip may extend substantially the width of a first edge of a label and partially the width of a third edge of a label. In other embodiments the L-shaped tear-strip may extend substantially the width of a first edge of a label (from the third edge to the fourth edge) and substantially the width of a third edge of a label (from the first edge to the second edge). In yet other embodiments, the L-shaped tear strip may extend partially the width of a first edge of a label and partially the width of a third edge of a label.

FIG. 2 is a schematic top view of a second embodiment of a label according to the present application. Label 210 of FIG. 2 is similar to label 10 of FIG. 1, with the exception that, in the embodiment of FIG. 2, label 210 includes tear strip 230 (having first end 231 and second end 232) that extends partially the width of first edge 212 and partially the width of third edge 216.

Similar to label 10 of FIG. 1, label 210 of FIG. 2 includes a first edge 212 and an opposing second edge 214 connected by third edge 216 and fourth edge 218. Label 210 also includes first tab 220 and second tab 222. First tab 220 is near first end 231 of tear strip 230. Second tab 222 includes first side 224, adjoining second side 226 and adjoining third side 228.

Tear strip 230 has first portion 234 and second portion 236. Tear strip 230 also includes first border 242, second border 244, third border 246, and fourth border 248. First portion 234 (having first border 242 and opposing second border 244) of tear-strip 230 is adjacent first side 224 of second tab 222; second portion 236 (having third border 246 and opposing fourth border 248) of tear-strip 230 is adjacent second side 226 of second tab 222; and label interior 240 is adjacent and surrounds third side 228 of second tab 222. More specifically, first border 242 of first portion 234 is adjacent first side 224 of second tab 222, second border 244 of first portion 234 is adjacent first edge 212 of label 210, third border 246 of second portion 236 is adjacent second side 226 of second tab 222, and fourth border 248 of second portion 236 is adjacent third edge 216 of label 210.

Tear strip 230 also includes scored edge 233. Scored edge 233 is substantially positioned in label interior 240 and is also adjacent first border 242 and third border 246. Label interior 240 is any area of label 210 not adjacent first edge 212, opposing second edge 214, third edge 216 or fourth edge 218.

In the embodiment shown in FIG. 2, tear strip 230 is defined by scored edge 233 and at least a segment of each of first edge 212 and third edge 216.

In the embodiment shown in FIG. 2, second tab 222 is defined by first border 242 of first portion 234 of tear strip 230, third border 246 of second portion 236 of tear strip 230 and label interior 240. As such, second tab 222 is not defined by first edge 212 of label 210 or third edge 216 of label 210.

First portion 234 of tear strip 230 is positioned between and adjacent first side 224 such that first side 224 is not adjacent first edge 212, second portion 236 of tear strip 230 is positioned between and adjacent second side 226 such that second side 226 is not adjacent third edge 216, and label interior 240 is positioned adjacent and surrounds third side 228, such that no sides of second tab 222 are adjacent first edge 212, second edge 214, third edge 216 or fourth edge 218. As with second tab 22, second tab 222 may function as a fully-enclosed peel tab, not accessible from edges of label 10.

Figure 3:
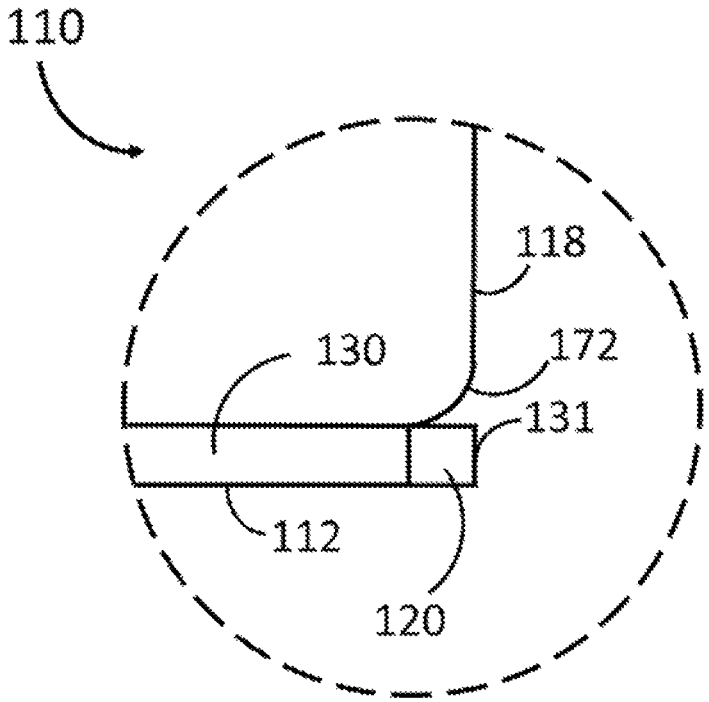
FIG. 3 is a schematic top view of a third embodiment a label according to the present application.

To use label 10, 210 on a package or otherwise, an end-user grasps and pulls first tab 20, 220 to remove tear-strip 30, 230. First tab 20, 220 and tear-strip 30, 230 are designed to concentrate forces to remove tear-strip 30, 230 from label 10, 210 but not to remove label 10, 210 from a package or otherwise. A non-limiting example of such a design is depicted in FIG. 3. FIG. 3 is a schematic top view of a third embodiment of a label according to the present application. FIG. 3 depicts an exploded section of label 110 at the intersection or connection of first edge 112 and fourth edge 118. Label 110 includes first tab 120 at first end 131 of tear strip 130. Label 110 also includes rounded corner 172 at the intersection or connection of first edge 112 and fourth edge 118. In the various embodiments of label 10 or label 110 or label 210 or other labels as described in the present application, removing tear-strip 30, 130, 230 from label 10, 110, 210 exposes second tab 22, 222. In this manner, in various embodiments, second tab 22, 222 operates as a corner tab for opening a package or otherwise removing a label. An end-user grasps and pulls second tab 22, 222 to partially or fully remove label 10, 110, 210 from a package or otherwise and, in some embodiments, to access package contents. In some embodiments, after accessing package contents, an end-user may then reseal label 10, 110, 210, as disclosed in, for example, U.S. Pat. No. 4,679,693 (Forman), U.S. Pat. No. 7,681,732 (Moehlenbrock et al.), U.S. Pat. No. 6,589,622 (Scott) or U.S. Pat. No. 7,717,620 (Hebert et al.). Second tab 22, 222 is near, but not adjacent, a corner of label 10, 110, 210 prior to an end-user removing tear strip 30, 130, 230. In other words, second tab 22, 222 is not defined by label edges (e.g., first edge 12, 212 and third edge 16, 216) prior to an end-user removing tear strip 30, 130, 230.

Figure 4:
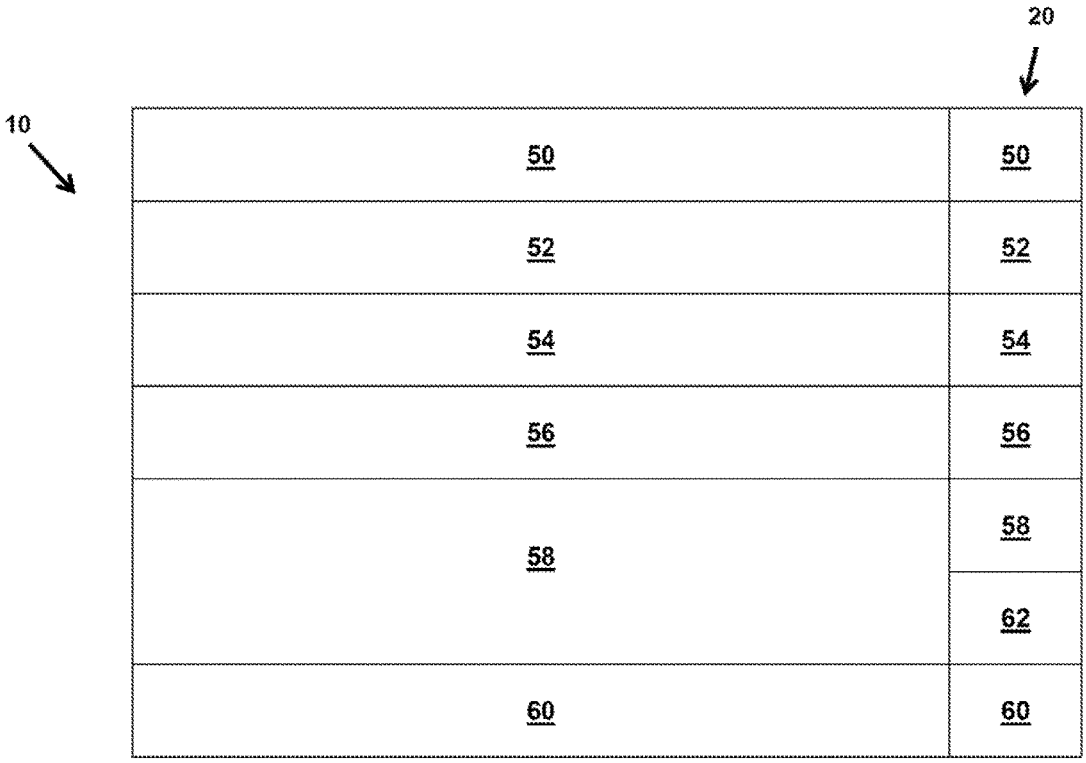
FIG. 4 is a schematic cross-sectional view of the label of FIG. 1, taken along line 4-4.

Label 10, 110, 210 may be a monolayer label or a multilayer label. In some embodiments, the structure (e.g., the scored edges and the properties of the various layers and how they are bonded) of a multilayer label 10, 110, 210 may facilitate its use. FIG. 4 is a schematic cross-sectional view of the label of FIG. 1, taken along line 4-4. In one embodiment, label 10 is a multilayer label and comprises first layer 50, second layer 52, third layer 54, fourth layer 56, fifth layer 58 and sixth layer 60.

First layer 50 may be an overlaminate layer. This overlaminate layer may be an abuse layer that withstands contact from other items and/or protects other layers of label 10. In some embodiments, first layer 50 may comprise oriented polypropylene (OPP).

Second layer 52 may be an adhesive layer securing first layer 50 to third layer 54 or fourth layer 56 or other layers of label 10. In some embodiments, second layer 52 may comprise a UV adhesive.

Third layer 54 may be an indicia layer and may comprise printing inks.

Fourth layer 56 may be a label stock layer. The label stock layer may also be known as a carrier layer. In various embodiments, fourth layer 56 may comprise paper, nonwoven or woven material, latex material, plastic or thermoplastic material, foil or other material as known to a person of ordinary skill in the label arts.

Fifth layer 58 may be a removable adhesive layer. Removable adhesives are designed to form temporary bonds and can be removed after hours, days, months or years. Some removable adhesives are designed to repeatedly separate and reattach. A non-limiting example of a removable adhesive is a pressure sensitive adhesive (PSA). Non-limiting examples of pressure sensitive adhesives (PSA) include but are not limited to those compositions that comprise a base elastomeric resin and a tackifier to enhance the ability of the adhesive to instantly bond and to enhance the bond strength. Examples of elastomers used as the base resin in tackified multicomponent PSA include but are not limited to natural rubber, polybutadiene, polyorganosiloxanes, styrene-butadiene rubber, carboxylated styrene-butadiene rubber, polyisobutylene, butyl rubber, halogenated butyl rubber, block polymers based on styrene with isoprene, butadiene, ethylene-propylene or ethylene-butylene, or combinations of such elastomers. (See Yorkgitis, "Adhesive Compounds," *Encyclopedia of Polymer Science and Technology,* Third Edition, 2003, Volume 1, pp. 256-290 (John Wiley & Sons, Inc., Hoboken, N.J.).)

Sixth layer 60 may be a release liner or a film layer. In embodiments prior to application of label 10 to a package or otherwise, sixth layer 60 may be a release liner. In these embodiments, the release liner may be a paper or plastic or thermoplastic carrier web material, any of which is coated on one or two sides with a release agent providing a release effect against a removable adhesive of fifth layer 58. The release agent may be solvent-based or water based and may be silicone, release varnish, release lacquer or any other release agent.

In other embodiments, sixth layer 60 may be a film layer. In these embodiments, the film layer may be thermoplastic and may be a monolayer film or a multilayer film. A non-limit example of a multilayer film comprising sixth layer 60 is shown in Table 1.

TABLE 1

| Layer | Composition |
|---|---|
| Layer 1 | oriented polyethylene terephthalate (OPET) |
| Layer 2 | adhesive |
| Layer 3 | blend of low density polyethylene (LDPE) and linear low density polyethylene (LLDPE) |
| Layer 4 | anhydride-modified Linear low density polyethylene (LLDPE) |
| Layer 5 | ethylene vinyl alcohol copolymer (EVOH) (e.g with 38 mol % ethylene) |

TABLE 1-continued

| Layer | Composition |
|---|---|
| Layer 6 | anhydride-modified Linear low density polyethylene (LLDPE) |
| Layer 7 | blend of low density polyethylene (LDPE) and linear low density polyethylene (LLDPE) |

As known to a person of ordinary skill in the packaging arts, the blend of LDPE and LLDPE in Layer 7 of this non-limiting example of sixth layer 60 may be considered a sealant layer, which may be considered to be a layer of film involved in the sealing of the film to itself and/or to another layer of the same or another film, sheet, etc.

As depicted in FIG. 4 (and in FIG. 5 described below), sixth layer 60 is coextensive with (i.e., having the same width as) the other layers of label 10. However, as known to a person of ordinary skill in the packaging arts, in some embodiments, sixth layer 60 may not be coextensive with the other layers of label 10. Sixth layer 60 may have a width that is less than or greater than the width of the other layers. For example, if label 10 is used as a lidstock or lidding film, sixth layer 60 may have a width that is greater than the width of the other layers to provide a margin for sealing label 10 to a tray (for example, via a sealant payer in sixth layer 60).

As described above, label 10 may be placed on or sealed to a package to facilitate access to contents of a package. To permit access, sixth layer 60, as an exterior layer adjacent the package, may be scored in various patterns to be consistent with patterns of permanent and/or removable (e.g., pressure sensitive) adhesive in label 10 (including but not limited to in sixth layer 60 of label 10), as disclosed in, for example, U.S. Pat. No. 7,681,732 (Moehlenbrock et al.), U.S. Pat. No. 6,589,622 (Scott), U.S. Pat. No. 7,717,620 (Hebert et al.) or PCT International Publication Number 2015/002651 (Curwood, Inc.).

As depicted in FIG. 4, label 10 also includes first section 62. First section 62 is designed to facilitate grasping of first tab 20. First section 62 may comprise release agent (e.g., as described above), a removable adhesive with lower bond strength than the removable adhesive of fifth layer 58, no material (e.g., a "blank" area) or other materials to facilitate "deadening" of first tab 20 and the ability of an end-user to grasp first tab 20 at first end 31 of tear strip 30. In this manner, only a portion of tear strip 30 has a release agent or is otherwise "deadened." If the removable adhesive of fifth layer 58 is "flood coated," i.e., applied to the entirety of label 10, first section 62 may be positioned above or below (as depicted in FIG. 4) fifth layer 58, depending on the desired location of removable adhesive (as known to a person of ordinary skill in the packaging arts). If the removable adhesive of fifth layer 58 is "pattern applied," i.e., applied to less than the entirety of label 10, first section 62 may be positioned adjacent but not above or below the removable adhesive of fifth layer 58 (not depicted).

Figure 5:
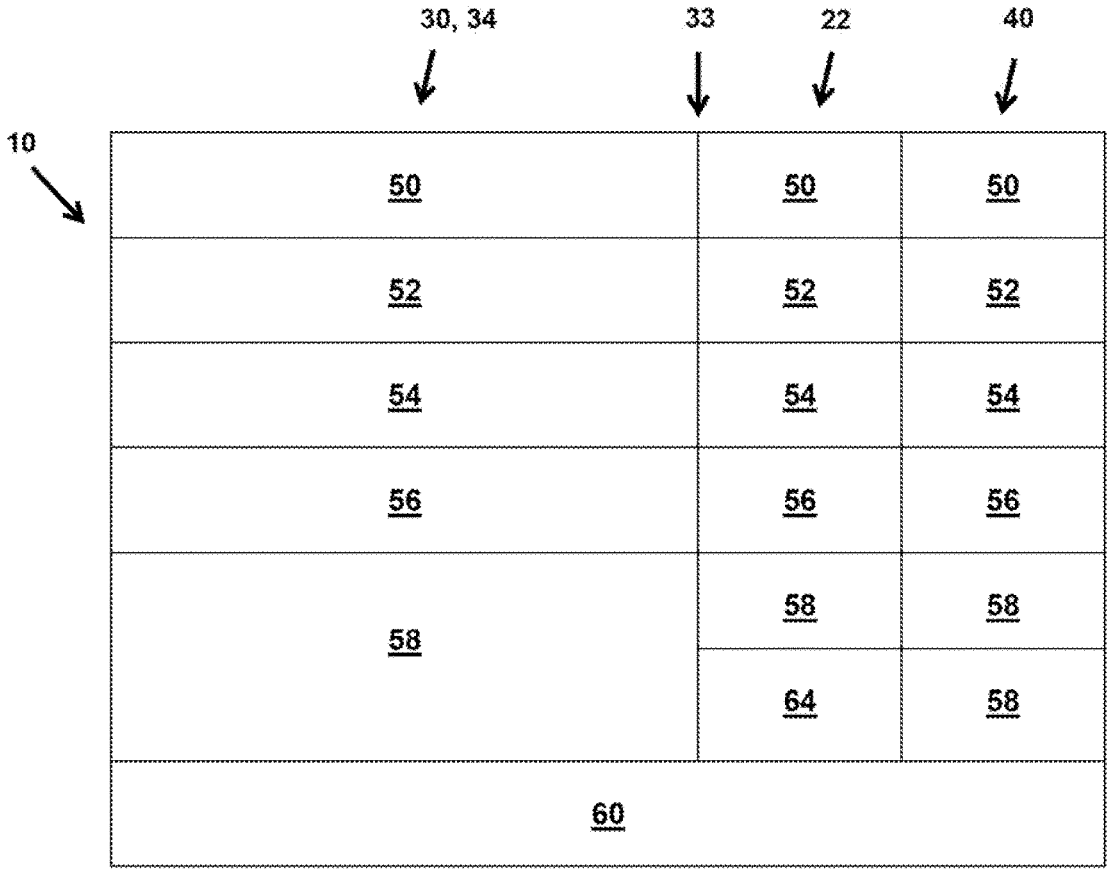
FIG. 5 is a schematic cross-sectional view of the label of FIG. 1, taken along line 5-5.

FIG. 5 is a schematic cross-sectional view of the label of FIG. 1, taken along line 5-5. In one embodiment, label 10 comprises first layer 50, second layer 52, third layer 54, fourth layer 56, fifth layer 58 and sixth layer 60. First layer 50, second layer 52, third layer 54, fourth layer 56, fifth layer 58 and sixth layer 60 are as described above. As depicted in FIG. 5, label 10 also includes second section 64. Second section 64 is designed to facilitate grasping of second tab 22 when tear strip 30, having first portion 34 and having scored edge 33, is removed.

As noted above, scored edge 33 may have varying depth. Its depth may extend throughout the entire thickness of label 10, or its depth may extend only through a portion of the thickness of label 10. As noted in FIG. 5, scored edge 33 extends only through a portion of the thickness of label 10 and does not extend through sixth layer 60.

Similar to first section 62, second section 64 may comprise release agent (e.g., as described above), a removable adhesive with lower bond strength than the removable adhesive of fifth layer 58, no material (e.g., a "blank" area) or other materials to facilitate "deadening" of second tab 22 and the ability of an end-use to grasp second tab 22. If the removable adhesive of fifth layer 58 is "flood coated," i.e., applied to the entirety of label 10, second section 64 may be positioned above or below (as depicted in FIG. 5) fifth layer 58, depending on the desired location of removable adhesive (as known to a person of ordinary skill in the packaging arts). If the removable adhesive of fifth layer 58 is "pattern applied," i.e., applied to less than the entirety of label 10, second section 64 may be positioned adjacent but not above or below the removable adhesive of fifth layer 58 (not depicted). In some embodiments, second section 64 may be the full area of second tab 22 (as depicted in FIG. 5). In other embodiments, second section 64 may be less than the full area of second tab 22 such that, for example, some removable adhesive is not "deadened" and some adhesive effect remains on second tab 22.

As depicted in FIG. 5, second section 64 (i.e., the "deadened" area of second tab 22) is adjacent and positioned between each of tear strip 30 and label interior 40. As such, no part of second tab 22 is exposed to any edge of label 10. As further depicted in FIG. 5, tear strip 30 and second tab 22 comprise the same or similar materials and are in the same plane in this cross-sectional view of label 10. In other words, tear strip 30 does not cover and does not otherwise overlay second tab 22 in this cross-sectional view.

Spatially related terms, such as, for example, "lower," "upper," "beneath," "below," "above," "top," and "bottom" if used in this application, are utilized for ease of description to describe spatial relationships of an element(s) to another. Such spatially related terms encompass different orientations of the label in use or operation in addition to the particular orientations depicted in the figures and described in this application. For example, if an object depicted in the figures is turned over, portions previously described as below or beneath other elements would then be above those other elements. Additionally, if an object depicted in the figures is rotated 180°, portions previously described as on top or on bottom would then be on bottom or on top.

The following documents may assist in describing various elements and aspects of the various embodiment of the label described in this application. However, neither any one nor any combination of the following describes all elements or all aspects of any one embodiment: U.S. Pat. No. 4,679,693 (Forman), U.S. Pat. No. 7,681,732 (Moehlenbrock et al.), U.S. Pat. No. 5,325,968 (Sowden), U.S. Pat. No. 5,758,774 (Leblong), U.S. Pat. No. 6,589,622 (Scott), U.S. Pat. No. 5,405,692 (Wang et al.), U.S. Pat. No. 4,840,270 (Caputo et al.), U.S. Pat. No. 5,456,928 (Hustad et al.), U.S. Pat. No. 5,725,311 (Ponsi et al.), U.S. Pat. No. 5,873,483 (Görtz et al.), U.S. Pat. No. 6,026,␣(Nakamura et al.), U.S. Pat. No 6,329,034 (Pendry et al.), U.S. Pat. No. 6,874,623 (Bray), U.S. Pat. No. 6,918,532 (Sierra-Gomez et al.), U.S. Pat. No. 7,344,744 (Sierra-Gomez et al.), U.S. Pat. No. 7,497,331 (Pham), U.S. Pat. No. 7,717,620 (Hebert et al.), U.S. Pat. No. 7,963,413 (Sierra-Gomez et al.), U.S. Pat. No. 8,028,851 (Vovan et al.), U.S. Pat. No. 8,256,636 (Huffer), U.S. Pat. No, 8,541,081 (Ranganathan et al.). U.S. Pat. No. 8,545,099 (Davis et al.), U.S. Pat. No. 8,684,217 (corresponding to US Patent Application Pub. No. 201210152954) (Bruehl et al.), U.S. Pat. No. 8,672,166 (Nazareth et al.), US Patent Application Pub. No. 2007/0289893 (Williams, Jr.), US Patent Application Pub. No. 2013/0320019 (Tinoco et al.), US Patent Application Pub. No. 201310337212 (Jensen), PCT International Publication Number WO 2012/128981 A1 (Avery Dennison Corporation), PCT International Publication Number WO 2014/142886 A1 (Printpack Illinois, Inc.), PCT International Application Number PCT/US13/49260 (corresponding to PCT International Publication Number WO 2015/002651) (Curwood, Inc.).

Each and every document cited in this present application, including any cross referenced or related patent or application, is incorporated in this present application in its entirety by this reference, unless expressly excluded or otherwise limited. The citation of any document is not an admission that it is prior art with respect to any embodiment disclosed or claimed in this present application or that it alone, or in any combination with any other reference or references, teaches, suggests or discloses any such embodiment. Further, to the extent that any meaning or definition of a term in this present application conflicts with any meaning or definition of the same term in a document incorporated by reference, the meaning or definition assigned to that term in this present application governs.

The above description, examples and embodiments disclosed are illustrative only and should not be interpreted as limiting. The present invention includes the description, examples and embodiments disclosed; but it is not limited to such description, examples or embodiments. Modifications and other embodiments will be apparent to a person of ordinary skill in the packaging arts, and all such modifications and other embodiments are intended and deemed to be within the scope of the present invention as described in the claims. The reference numbers included the claims are provided as examples for reference and should not be considered as limiting.

What is claimed is as follows:

1. A label (10, 110, 210) comprising a first edge (12, 112, 212), a second edge (14, 214), a third edge (16, 216), a fourth edge (18, 118, 218) and a label interior (40, 240), wherein the second edge (14, 214) opposes the first edge (12, 112, 212), the third edge (16, 216) connects the first edge (12, 112, 212) and the second edge (14, 214), and the fourth edge (18, 118, 218) connects the first edge (12, 112, 212) and the second edge (14, 214);

a tear strip (30, 130, 230) comprising a first tab (20, 120, 220), a first portion (34, 234) having a first border (42, 242) and an opposing second border (44, 244), a second portion (36, 236) having a third border (46, 246) and an opposing fourth border (48, 248), and a scored edge (33, 233), wherein the second border (44, 244) is adjacent the first edge (12, 112, 212) of the label (10, 110, 210), the fourth border (48, 248) is adjacent the third edge (16, 216) of the label, and the scored edge (33, 233) is adjacent the first border (42, 242) and the third border (46, 246), wherein the tear strip (30, 130, 230) is defined by the scored edge (33, 233) and at least a segment of each of the first edge (12, 112, 212) of the label (10, 110, 210) and the third edge of the label (10, 110, 210);

a second tab (22, 222) comprising a first side (24, 224) and a second side (26, 226), wherein the first side (24, 224) is adjacent the first border (42, 242) of the first portion (34, 234) of the tear strip (30, 130, 230) and the second side (26, 226) is adjacent the third border (46, 246) of the second portion (36, 236) of the tear strip (30, 130, 230), wherein the second tab (22, 222) is defined by the first border (42, 242), the third border (46, 246) and the label interior (40, 240).

2. The label (10, 110, 210) of claim 1 wherein the first tab (20, 120,220) facilitates removal of the tear strip (30, 130, 230) from the label (10, 110, 210).

3. The label (10, 110, 210) of claim 1 wherein the second tab (22, 222) facilitates removal of the label (10, 110, 210).

4. The label (10, 110, 210) of claim 1 wherein the tear strip (30, 130, 230) is further defined by at least a segment of the fourth edge (1 18, 218) of the label (10, 110, 210) and the tear strip (30, 130, 230) extends the width of the first edge (12, 112, 212) of the label (10, 110, 210) from the third edge (16 216) of the label (10, 110, 210) to the fourth edge (18, 118, 218) of the label (10, 110, 210).

5. The label (10, 110, 210) of claim 4 wherein the label (10, 110, 210) includes a rounded corner (172) at the connection of the first edge (12, 112, 212) of the label (10, 110, 210) and the fourth edge (18, 118, 218) of the label (10, 110, 210).

6. The label (10, 110, 210) of claim 1 wherein the tear strip (30, 130, 230) extends partially the width of the first edge (12, 112, 212) of the label (10, 110, 210) and partially the width of the third edge (16, 216) of the label (10, 110, 210).

7. The label (10, 110, 210) of claim 1 wherein the second tab (22, 222) has a shape of a right triangle.

8. The label (10, 110, 210) of claim 1 wherein the second tab (22, 222) has a shape of a circle, half-circle, oval, half-oval, square, rectangle, pentagon or hexagon.

9. The label (10, 110, 210) of claim 1 wherein the tear strip (30, 130, 230) and the second tab (22, 222) are in the same plane.

10. The label (10, 110, 210) of claim 1 wherein the label (10, 110, 210) is a multilayer label.

11. The label (10, 110, 210) of claim 10 wherein the label (10, 110, 210) comprises a removable adhesive layer (58).

12. The label (10, 110, 210) of claim 11 wherein the removable adhesive layer (68) comprises material (62, 64) to facilitate grasping of the first tab (20, 120, 220), the second tab (22, 222), or both the first tab (20, 120, 220) and the second tab (22, 222).

13. The label (10, 110, 210) of claim 10 wherein the label (10, 110, 210) comprises an exterior layer (60).

14. The label (10, 110, 210) of claim 13 wherein the exterior layer (60) is scored.

15. The label (10, 110, 210) of claim 13 wherein the exterior layer (60) comprises a sealant layer.

16. A package comprising the label (10, 110, 210) of claim 1.

17. The package of claim 16 wherein the package is a tray.

* * * * *